US007737423B2

(12) United States Patent
Burth et al.

(10) Patent No.: US 7,737,423 B2
(45) Date of Patent: Jun. 15, 2010

(54) CENTRAL DRYER FOR ELECTRON BEAM CURING

(76) Inventors: Dirk Burth, Sittenbachstr. 19, 85235 Odelzhausen (DE); Bengt Laurell, Bjoerkhagen Tolarp, SE-30594 Halmstad (SE)

( * ) Notice: Subject to any disclaimer, the term of this patent is extended or adjusted under 35 U.S.C. 154(b) by 253 days.

(21) Appl. No.: 11/847,929

(22) Filed: Aug. 30, 2007

(65) Prior Publication Data

US 2008/0087845 A1 Apr. 17, 2008

(30) Foreign Application Priority Data

Sep. 2, 2006 (DE) ..... 10 2006 041 257
Dec. 8, 2006 (DE) ..... 10 2006 057 966

(51) Int. Cl.
*B05D 3/06* (2006.01)
*G21K 5/00* (2006.01)

(52) U.S. Cl. ..... 250/492.3; 250/492.1; 250/400; 250/433; 250/453.11; 427/566; 118/642; 118/641

(58) Field of Classification Search ..... 250/492.3, 250/492.1, 400, 433, 453.11; 427/566; 118/642, 118/641

See application file for complete search history.

(56) References Cited

U.S. PATENT DOCUMENTS

| | | | | |
|---|---|---|---|---|
| 3,728,147 | A | 4/1973 | Jenkins et al. | |
| 3,924,022 | A | 12/1975 | Schroeter et al. | |
| 4,246,297 | A | 1/1981 | Nablo et al. | |
| 4,385,239 | A * | 5/1983 | Miller | 250/492.3 |
| 4,642,244 | A * | 2/1987 | Tripp et al. | 427/495 |
| 5,634,402 | A | 6/1997 | Rudd et al. | |
| 2002/0156142 | A1 | 10/2002 | Mikhael et al. | |
| 2004/0178363 | A1 | 9/2004 | Tominaga et al. | |

FOREIGN PATENT DOCUMENTS

| | | | |
|---|---|---|---|
| AU | 197614868 | A1 | 4/1980 |
| DE | 2627147 | B2 | 4/1980 |
| DE | 20117364 | U1 | 3/2002 |
| EP | 0228671 | A1 | 7/1987 |
| WO | 02/064268 | A1 | 8/2002 |
| WO | WO2006047866 | A1 | 5/2006 |

* cited by examiner

*Primary Examiner*—Nikita Wells
(74) *Attorney, Agent, or Firm*—Pearne & Gordon LLP

(57) ABSTRACT

A central dryer for electron beam curing is described which includes a first application unit for the application of a first coating to a web. The central dryer for electron beam curing also includes an irradiation unit in which a first electron beam generator and a second electron beam generator are arranged for the irradiation of the web. The electron beam generators arranged in the irradiation unit have connections for at least one pump system to generate an operating vacuum. In addition to this the central dryer for electron beam curing also has a web guiding system which feeds the web successively but not necessarily in direct succession, to the first application unit, the first electron beam generator, the second electron beam generator.

27 Claims, 7 Drawing Sheets

CENTRAL DRYER FOR ELECTRON BEAM CURING

FIELD OF THE INVENTION

The invention refers to a central dryer for electron beam curing and a printing press with at least one central dryer for electron beam curing. The invention further refers to a method for application of at least one coating to a web as well as a method for application of at least two coatings to a web.

BACKROUND OF THE INVENTION

Up to now, UV radiation systems were generally used for beam hardening of ink coatings, varnish coatings, adhesive coatings and other coatings applied to a web. The use of UV radiation systems, however, requires the addition of photoinitiators in proportions of 0.5% to 10% to the coating material in order to initiate the curing process. In many cases, however, the use of photoinitiators is a problem due to concerns about food safety. Particularly in the area of food packaging there are thus strict limit values regarding the migration of photoinitiators from the packaging material. Photoinitiators are also expensive. In addition to this, curing is difficult in absorbent inks because the photoinitiator does not receive enough light.

As an alternative to UV radiation it is also possible to use electron beams to cure ink applications and other coatings. Compared with UV radiation, electron beam curing (EBC) has the advantage that no photoinitiators are required. Up to now, however, the use of an electron beam curing system was associated with very high procurement costs.

It is thus an object of the invention to improve the economic feasibility of the use of electron beam curing.

The object of the invention is solved by a central dryer for electron beam curing according to claim 1, by a printing press according to claim 19, by a method for application of at least one coating on a web according to claim 20, and by a method for application of at least two coatings on a web according to claim 21.

SUMMARY OF THE INVENTION

A central dryer for electron beam curing according to the invention includes a first application unit to apply a first coating to a web as well as an irradiation unit in which a first electron beam generator and a second electron beam generator are arranged to irradiate the web. The electron beam generators arranged within the irradiation unit have connections for at least one pump system to generate an operating vacuum. The central dryer for electron beam curing also includes a web guiding system which feeds the web successively, but not necessarily in direct succession, to the first application unit, the first electron beam generator, the second electron beam generator.

Due to the arrangement of at least two electron beam generators in a single irradiation unit, the irradiation dose required for each processing run can be provided in a flexible and cost-efficient manner. The web guiding system is designed in such a way that, whenever it is to be beamed with electrons, the web is led through the joint irradiation unit and irradiated by at least one of the electron beam generators. This means that the respective required degree of intermediate drying can be set at defined points of the process. For example, after passing one application unit the web can be led successively to the first and second electron beam generator in order to apply a sufficiently high irradiation dose to the web. Alternatively, after passing the first application unit, the web can, for example, be led to the first electron beam generator, then out of the irradiation unit and then, after passing through other processing stations, into the second electron beam generator.

The central dryer for electron beam curing according to the invention is designed to provide the required irradiation dose at any desired point of the web coating process in a flexible and cost-efficient manner. Instead of having to buy separate electron beam units, at least two electron beam generators are integrated in a single irradiation unit. This substantially reduces the procurement costs of the irradiation unit.

The central dryer for electron beam curing according to the invention is suitable, for example, for electron beam curing of coatings applied to the web with the aid of application units. Various embodiments of the present invention make it possible to make electron beam curing competitive with regard to UV curing, particularly when high irradiation doses or a number of irradiations at different points are required.

In accordance with one advantageous embodiment, the web guiding system is designed in such a way that, after passing through the first application unit, the web is led into the irradiation unit where it is irradiated by the first electron beam generator and by the second electron beam generator, and then led out of the irradiation unit.

In this embodiment the first application unit applies a first coating to the web and then the web is beamed by the first electron beam generator and by the second electron beam generator. The web is coated by the first electron beam generator and by the second electron beam generator with a certain irradiation dose so that the total dose is composed of the contributions of the two electron beam generators. With the aid of two electron beam generators arranged in series it is possible to generate a substantially higher irradiation dose output.

In the field of electron beam curing, the dose output of an irradiator states the irradiated dose per time unit. The dose output is decisive if the operating speed of a system is to be increased. In electron beam systems the dose output is limited, as random quantities of electrons per time unit may not pass through the window material. If the flow of electrons is too high, the window material can overheat and be damaged. The dose output could be increased by enlarging the window surface area, but this is limited by the constructional size of the electron beam system and the dimensions of the available electron beam exit windows.

In electron beam generators up to now, the constructional size of the whole electron beam generator depends on the size of the required electron beam exit window. For example, an electron beam generator can have a cylindrical housing of defined radius whereby the window is integrated in the curve of the cylinder. The bigger the window, the bigger the radius of the cylindrical housing. By dividing the dose output over a number of electron beam generators, the window of each individual electron beam generator can be made smaller. The individual electron beam generators are thus substantially smaller in radius and thus in height. Compared with an individual irradiation unit with the same dose output, an electron beam unit made up of a number of electron beam generators arranged in series has a considerably lower constructional height.

By using a number of electron beam generators a large diversity of constructional dimensions is possible for a specified dose output. This is an advantage because in present-day irradiation systems, for example in printing and coating machines, there is often very little space available.

Due to the overall smaller constructional size of the electron beam generators arranged in series, the overall volume that has to be evacuated is considerably smaller. This means that the systems can be more quickly evacuated and are ready again much quicker for production, for example after changing the foil, repair work etc. This is important for production as the hourly rates here are very high. Another advantage of the lower overall volume is that smaller pumps can also be used for evacuation.

A further advantage is that the tubes are so small that they can be replaced by hand. In the event of a defect, or when replacing the windows, the whole tube can be replaced by a complete exchange tube. This increases productivity and minimises down times.

In accordance with one advantageous embodiment, the first electron beam generator and the second electron beam generator are designed for electron beam curing of the first coating. The irradiation dose available for curing the first coating is made up of the contributions of the first and second electron beam generators, which means that a substantial increase of the irradiation dose can be achieved. This makes it possible to reliably cure even relatively slow-reacting coatings. Comparatively high irradiation doses are required for example to cure adhesive and varnish coats. In addition to this, the sufficient irradiation dose for curing of the applied coatings can be provided even at higher web speeds.

In accordance with another advantageous embodiment, the central dryer for electron beam curing includes a second application unit to apply a second coating to the web whereby the web guiding system is designed in such a way that the web is fed successively to the first application unit, the first electron beam generator, the second application unit, the second electron beam generator.

In this embodiment the web is not led directly to the second electron beam generator after passing the first electron beam generator, but passes from the first electron beam generator to a second application unit which applies a second coating and from there to the second electron beam generator. At least one electron beam generator is assigned to each application unit. By arranging the electron beam generators in a single vacuum unit, the constructional outlays are reduced.

It is advantageous when the first electron beam generator is designed for electron beam curing of the first coating and the second electron beam generator for electron beam curing of one or more previously applied coatings. First the first coating is cured and then the web is led into the second application unit. This can, for example in the case of low-viscosity inks, prevent the wet ink of the first application unit running with the wet ink of the second application unit and thus improve the quality of the printing process. This is particularly important in the case of flexographic printing and intaglio printing, as low-viscosity inks are used in these processes.

It is advantageous when the web guiding system is designed in such a way that, after passing through the first application unit, the web is led into the irradiation unit where it is irradiated by the first electron beam generator, then led out of the irradiation unit and passed to the second application unit and, after passing the second application unit, it is led to the irradiation unit where the web is irradiated by the second electron beam generator and then led out of the irradiation unit.

According to a further preferred embodiment, the central dryer for electron beam curing includes several application units and several electron beam generators arranged within the vacuum unit, whereby at least one electron beam generator is allocated to each application unit. The guiding track is designed in such a way that, after passing through one application unit, the web is led into the irradiation unit where it is irradiated by the at least one assigned electron beam generator and then led out of the irradiation unit.

Preferably, one electron beam generator assigned to an application unit is designed in such a way as to cure the at least one coating applied by at least one application unit which has previously been passed through. In this way it can be ensured that a newly applied coating is cured before the web is passed on to the next application unit. This means that, for example in the case of low-viscosity printing inks, the wet inks from the different application units can be prevented from running into each other and the quality of the printing process increased.

In accordance with a preferred embodiment, each of the electron beam generators arranged within the irradiation unit extends over the whole width of the web. This means that the web can beamed with electrons over its whole width, without the need for a number of electron beam generators arranged alongside each other.

It is advantageous if the irradiation unit is executed as a self-contained, separated module. Whenever an electron beam dose is required during the processing of the web, the web is led into the irradiation unit. This unit can accommodate, for example, the apparatus and systems required for the operation of the electron beam generator. The components of the irradiation unit can, for example, be executed as a module and removed from the overall assembly, for example, for service and maintenance purposes.

It is also advantageous if the irradiation unit is arranged in a spatially delineated area of the central dryer for electron beam curing. In particular it is advantageous if the application units are arranged in a first spatially delineated area of the central dryer for electron beam curing and the irradiation unit is arranged in a second spatially delineated area of the central dryer for electron beam curing. In this embodiment the web is brought back and forth between the application units and the irradiation unit during processing.

In accordance with an advantageous embodiment, the at least one application unit is arranged around the central irradiation unit. Due to the central arrangement of the irradiation unit the web can be easily transported between the application units and the irradiation unit.

It is advantageous when the at least one application unit includes one of the following: a laminating unit, a lining unit, an adhesive application unit, a printing ink application unit, a powder application unit, a coating unit, a varnish application unit, an extruder, an extruder with moulding tool. The combination of various application units with an irradiation unit gives rise to a complex processing system for finishing a web.

It is advantageous when at least one coating includes one or more of the following: a printing ink coating, a varnish coating, an adhesive coating, a lining coating with adhesive, a lamination coating, a plastic coating, a siliconisation or a finishing coating. These coatings are applied successively to the web by different types of application unit.

In a preferred embodiment, one or more of the application units are printing units for at least one of the following printing processes: flexographic printing, intaglio printing, screen printing, offset printing. In particular, the central dryer for electron beam curing is suitable for curing a newly applied coating of ink before the application of further coatings. This is important, for example, in the case of low-viscosity inks in order that the different colours from different application units do not run into each other.

It is also advantageous if one or more of the following are arranged between an application unit and an electron beam generator assigned to the application unit: web dryer, convection dryer, solvent dryer, excimer dryer, UV dryer, IR dryer, heat treatment unit. With the aid of a dryer, the watery or solvent proportion of a coating can be removed or at least reduced. In this way, for example, dispersion paints, dispersion adhesives, solvent paints, solvent adhesives can be cured by electron beam irradiation after application and drying.

According to a preferred embodiment the irradiation unit includes a joint screen for the electron beam generators arranged within the irradiation unit which is designed to screen off the high-energy radiation generated inside the irradiation unit. The screening housing which is preferably of lead or steel or a lead-steel construction contributes substantially to the costs of an electron beam curing system. In the embodiments of the present invention there is only one joint screen required for the electron beam generators arranged in the irradiation unit so that costs are also reduced in this respect.

In accordance with a preferred embodiment, the electron beam generators arranged inside the irradiation unit are connected to a joint vacuum system for all of the electron beam generators. The vacuum system provides the vacuum necessary for the operation of the electron beam generators.

The joint vacuum system preferably includes a pump system to generate the operating vacuum. As the electron beam generators are connected to a joint vacuum system, one pump system is sufficient to evacuate the electron beam generators. This again has a positive effect on the costs for the irradiation unit. Alternatively, a number of pumps can also be connected to the vacuum system.

A printing press in accordance with the invention includes at least one of the central dryers for electron beam curing described above.

With the aid of embodiments of the present invention the various coatings required in the manufacture of packaging or labels can be successively applied and cured. As, in contrast to UV curing, electron beam curing does not require the addition of photoinitiators, electron beam curing has advantages for applications in the packaging sector and, in particular, for the packaging of food.

BRIEF DESCRIPTION OF THE DRAWINGS

The invention is further described in the following on the basis of a number of embodiment examples shown in the drawing. The drawings are as follows.

DETAILED DESCRIPTION OF THE PREFERRED EMBODIMENTS OF THE INVENTION

Figure 1:
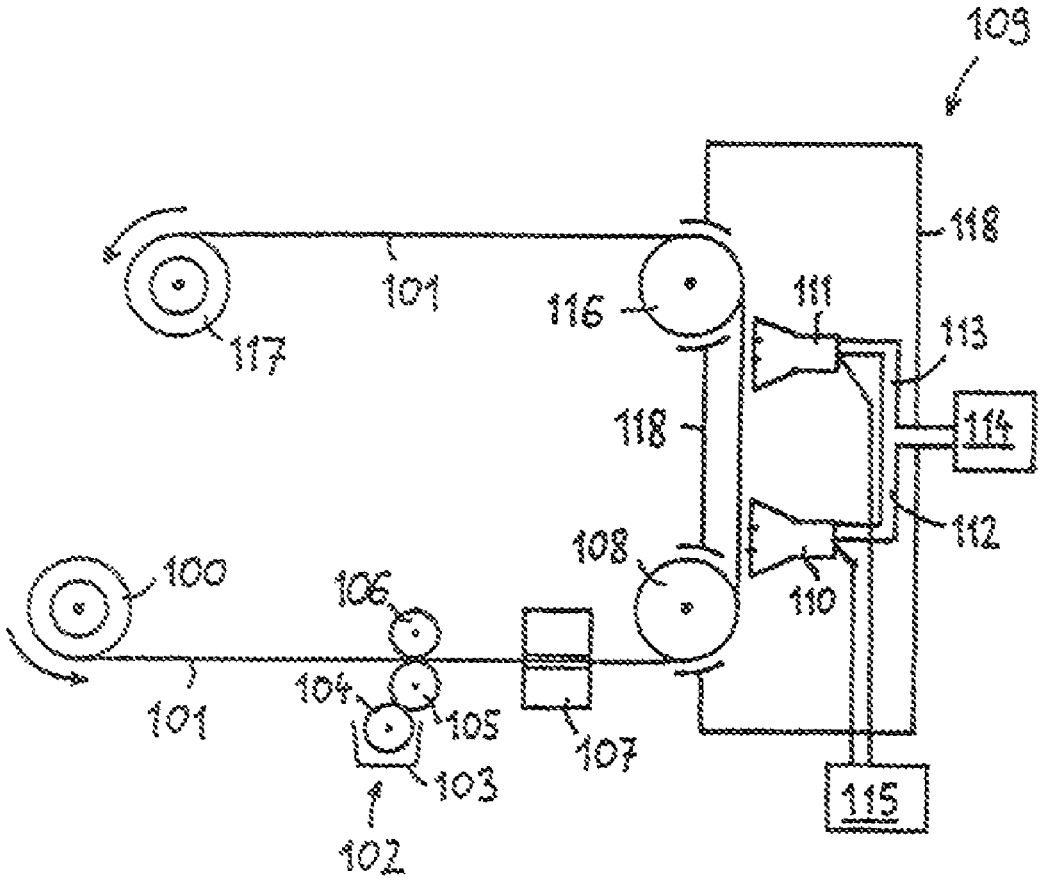
FIG. 1 shows a first embodiment of the invention in which a coating is cured by two electron beam generators arranged in series.

FIG. 1 shows a first embodiment of the invention in which a web passes a varnish application unit and two electron beam generators successively. The web 101 is led into a varnish application unit 102 from a feed roll 100.

The web 101 could be a roll of plastic, textile, non-woven fabric, tissue, metal etc. The width of the web typically ranges from 20 cm (labels) to a number of meters, while the thickness of the web can be between 6 μm and a number of millimeters. The varnish application unit 102 can, for example, include a trough 103, a transfer roller 104, an application roller 105 and a counterpressure roller 106.

As the web 101 passes through the varnish application unit 102 it receives a coat of varnish. The varnished web then runs through a dryer 107 which draws the solvent out of the applied coat of varnish. The dryer 107 can, for example, be executed as a convection dryer or an IR dryer. The web 101 is then led into an irradiation unit 109 via an inlet roller 108. Inside the irradiation unit 109 there is a first electron beam generator 110 and a second electron beam generator 111 whose dose output can be separately controlled. Each of the electron beam generators 110 and 111 has at least one electron exit window. The electron beam generators 110 and 111 can be arranged as shown in FIG. 1 at a certain distance from the rollers or, alternatively, they can be arranged directly above the rollers.

Inside the electron beam generators 110 and 111 there is a high vacuum suitable for the generation of electrons. To create this high vacuum the electron beam generators 110 and 111 are connected by pipelines 112 and 113 to a pump system 114. The pump system 114 can be located inside or outside of the irradiation unit 109. In the irradiation zone there is, preferably, an inert gas, such as for example nitrogen, in order to prevent a breakdown of the radical reaction due to the oxygen in the air. The irradiation unit 109 also includes a high-voltage generator 111 which supplies the acceleration voltage (and current) required to accelerate the electrons to the first electron beam generator 110 and the second electron beam generator 111. The acceleration voltage typically ranges between 25 kV and 300 kV.

The web 101 with the coat of varnish is moved successively past the first electron beam generator 110 and the second electron beam generator 111, at each of which the coated web is beamed with electrons. The beaming with electrons causes a bonding of the radiation-cured varnish and this gives rise to a hard, chemicals and abrasion-resistant, high-gloss film of varnish. After the curing process the printed web 101 is led out of the irradiation unit 109 via an outlet roller 116 and wound onto a take-up roller 117.

In accordance with an alternative embodiment of the invention, the layout shown in FIG. 1 can also be used to generate matted surfaces. By using a low acceleration voltage in the first electron beam generator 110 only the uppermost layer of the coating facing the irradiator is cured while the section underneath the surface of the coating remains fluid. The bonding of the upper section causes shrinkage which gives rise to a rough and thus matted surface. The second electron beam generator 111 cures with a higher acceleration speed so that the whole coating is hardened throughout. This means that a hard, matt, scratch-resistant surface can be generated without using matting agents.

In contrast to the competing UV curing systems, electron beam curing systems do not require that photoactive initiators are added to the varnish or printing ink. Also, with electron beam curing there are no problems of the varnish or printing ink not being permeated by the radiation due to absorption. In contrast to UV curing systems, electron beam curing systems have no problem curing coloured coatings throughout. Electron beam curing systems are used mainly in the printing of labels and packaging due to the advantages or rapid further processing and the low heat exposure of the web before the punch-out process.

As x-radiation occurs when high-energy electrons hit a surface, the irradiation unit 109 has a screen 118 arranged around the electron beam generators 110 and 111 to absorb and prevent the release of the x-rays. The screen 118 is preferably of lead or steel or of a lead-steel construction with a thickness of millimeters up to some centimeters. The inlet roller 108 and the outlet roller 116 through which the printed web is led into or out of the irradiation unit 109 are also of steel or lead. In particular it is specified that the gap between the inlet and outlet rollers 108 and 116 and the screen 118 is dimensioned in such a way that the x-rays can no longer exit after multiple refractions.

In the embodiment shown in FIG. 1 the beam-curing varnish applied to the web 101 is cured by two electron beam generators 110 and 111 arranged in series. This means that the coat of varnish is exposed to a radiation dose which is the sum of the radiation doses generated by the individual electron beam generators 110 and 111. By using a number of electron beam generators arranged in series the radiation dose necessary for the electron beam curing of the coat of varnish can be provided even at higher conveyor speeds.

The electron beam generators 110 and 111 can be evacuated with the aid of a single pump system 114. A single high-voltage generator 115 is sufficient to supply the electron beam generators 110 and 111 with the required acceleration voltage. A joint screen 118 is provided to protect against high-energy radiation.

Figure 2A:
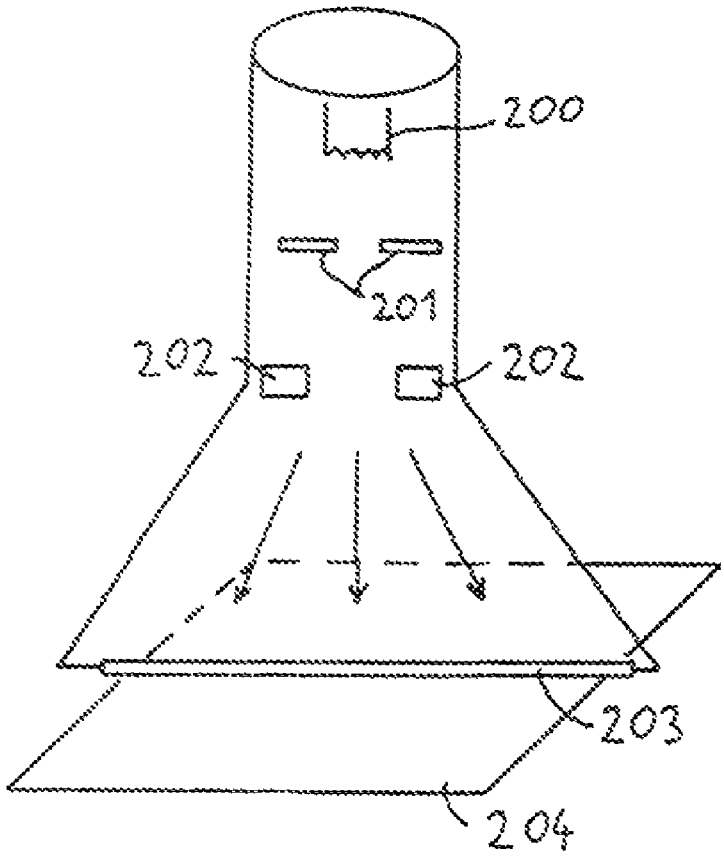
FIG. 2A shows a first embodiment of an electron beam generator.
Figure 2B:
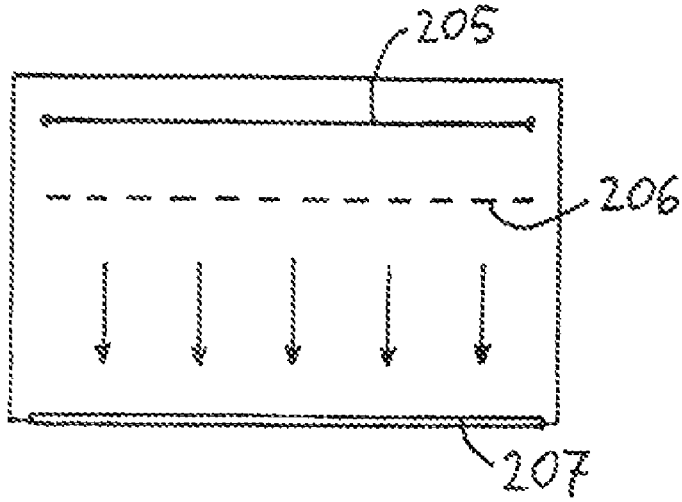
FIG. 2B shows a second embodiment of an electron beam generator.
Figure 2C:
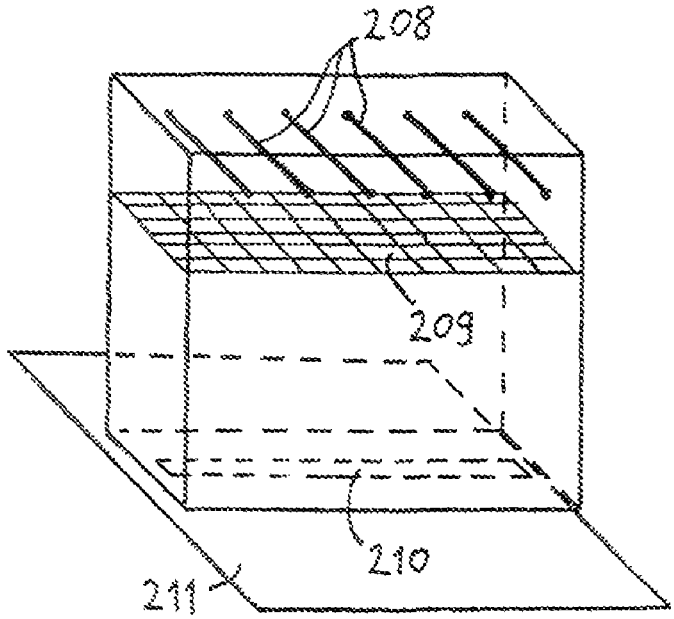
FIG. 2C shows a third embodiment of an electron beam generator.

FIG. 2A to FIG. 2C show various embodiments of electron beam generators. The electron beam generator shown in FIG. 2A includes a hot cathode 200 and an anode 201. An acceleration voltage of approx. 25 kV to 300 kV is applied between the hot cathode 200 and the anode 201 to accelerate the electrons emitted from the hot cathode 200. Then the electron beam is widened with the aid of deflection magnets 202. The electrons penetrate the electron exit window 203 and irradiate the web 204 with the coating to be cured.

FIG. 2B shows an alternative embodiment of an electron beam generator in which the hot cathode is executed as an elongated wire 205. The electrons are accelerated by the anode 206 and then penetrate the electron exit window 207.

FIG. 2C shows a further embodiment of an electron beam generator which includes a number of cathode wires 208. The electrons are accelerated by the anode 209. After penetrating the electron exit window 210, the accelerated electrons hit the web 211. The electron beam generator shown in FIG. 2C is particularly suitable for use in electron beam curing due to the high electron dose output.

Figure 3:
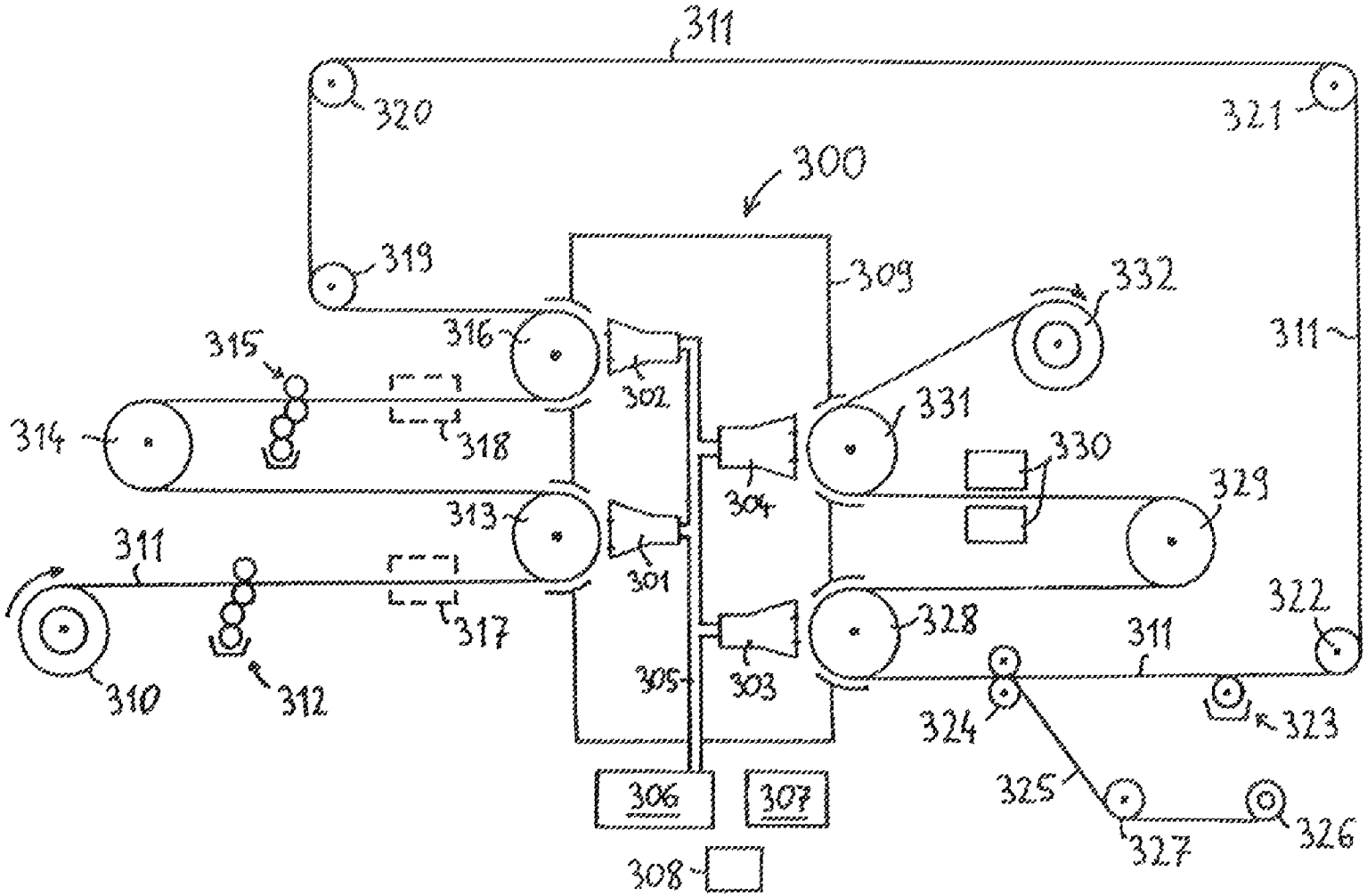
FIG. 3 shows a further embodiment of the invention which includes four application units and a central irradiation unit.

FIG. 3 shows a web-fed printing press in accordance with the invention with four application units arranged around a central irradiation unit 300. The central irradiation unit 300 includes four electron beam generators 301 to 304. The electron beam generators 301 to 304 are connected by tubes 305 with a joint pump system 306 which evacuates the connected electron beam generators to generate the operating vacuum required to accelerate the electrons. To supply the electron beam generators 301 to 304 with the required acceleration voltage (and current), the irradiation unit 300 includes a joint high-voltage source 307. In addition to this, the irradiation unit 300 is also equipped with a control unit 308 to control the dose output of the electron beam generators, whereby the dose output of the electron beam generators 301 to 304 can be controlled separately. The irradiation unit 300 is surrounded by a screen 309 of lead or steel or a lead-steel construction to protect against the release of high-energy x-rays.

A web 311 is fed from a feed roller 310 into a printing unit 312 which applies a first coat of ink to the web 311. To cure this coating of ink the web 311 is led into the irradiation unit 300 by means of a deflection roller 313 where the first ink coating is cured by the electron beam generator 301 and then led out of the irradiation unit 300. The web is then led into a second printing unit 315 by a deflection roller 314 where a second coating of ink is applied to the web 311. With the aid of deflection roller 316, the printed web 311 is led through the irradiation unit 300 where the second coating of printing ink is cured by the electron beam generator 302.

Web dryers 317 and 318 as shown in broken lines in FIG. 3 can also be arranged between the printing unit 312 and the defection roller 313 and between the printing unit 315 and the deflection roller 316. The web dryers 317 and 318 draw the solvent out of the applied ink coating and can be executed for example as convection dryers or IR dryers.

After the second coating of ink is cured, the web 311 is led via several rollers 319 to 322 to an adhesive application unit 323 which applies a coating of adhesive to the web 311. In the lining unit 324 the web 311 with the adhesive coating is lined with a plastic foil 325 which is fed into the lining unit 324 from a feeder roller 326 via a deflection roller 327. With the aid of the deflection roller 328 the web 311 with the applied plastic foil 325 is passed through the irradiation unit 300. The electron beam generator 303 irradiates the web with electrons and thus cures the adhesive coating between the web 311 and the plastic foil 325. By means of a deflection roller 329 the web is then passed through a further application unit 330 which applies, for example, a protective layer of plastic to the printed and lined web. The application unit 330 can, for example, be an extruder with moulding tool, a curtain coater, a spray nozzle, an anilox roller, a blade etc. If curtain coaters are used, several coatings can be applied simultaneously. The coated web is passed by electron beam generator 304 via a deflection roller 331 where the protective coating is cured or bonded by an electron beam. After beaming with electrons, the web is fed onto a take-up roller 332.

In the embodiment of the invention shown in FIG. 3, each of the four application units is assigned a corresponding electron beam generator within the irradiation unit 300. The electron beam generators are preferably arranged on several levels above each other to allow a compact construction of the central dryer for electron beam curing. This means that the available room height can be used to full advantage. The arrangement of the four electron beam generators 301 to 304 in a central irradiation unit 300 has the advantage that the screening, the systems for vacuum generation and the high-voltage generator for generation of the acceleration voltage (and current) do not have to be procured separately for each individual electron beam generator, but only once for the whole system. As the screening, the high-voltage generator and the systems necessary for vacuum generation are the cost-intensive elements of the irradiation system, this leads to considerable cost savings. This means that electron beam curing can compete with other chemical drying processes such as for example UV curing.

It must be emphasised that the central dryer for electron beam curing shown in FIG. 3 can have any type of application unit instead of the ones shown, whereby the web is always led into one or several electron beam generators in the central irradiation unit after passing through an application unit. For example, a central dryer for electron beam curing such as that shown in FIG. 3 can be used to realise a four-colour web-fed printing press. In particular it is suitable for flexographic, screen, intaglio and offset printing units.

Figure 4:
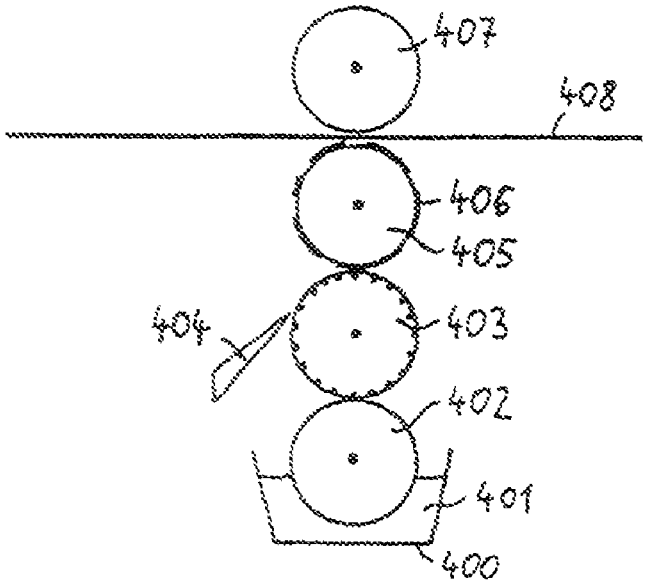
FIG. 4 shows the layout of a print station for flexographic printing.

FIG. 4 shows the setup for a printing press for flexographic printing. The printing press has a trough 400 containing fluid ink 401. The ink is taken up by the transfer roller 402 which applies the ink to an anilox roller 403 rotating directly above it. The surplus ink is skimmed off the anilox roller 403 with the aid of a squeegee 404. Above the anilox roller 403 there is a printing roller 405 which generates the actual print image with the aid of a rubber printing block 406. The anilox roller 403 serves to apply the ink evenly over the rubber printing block 406. The printing press also includes a counterpressure roller 407 which presses the web 408 onto the printing roller. When the web is passed between the printing roller 405 and the counterpressure roller 407, the ink is transferred.

Figure 5:
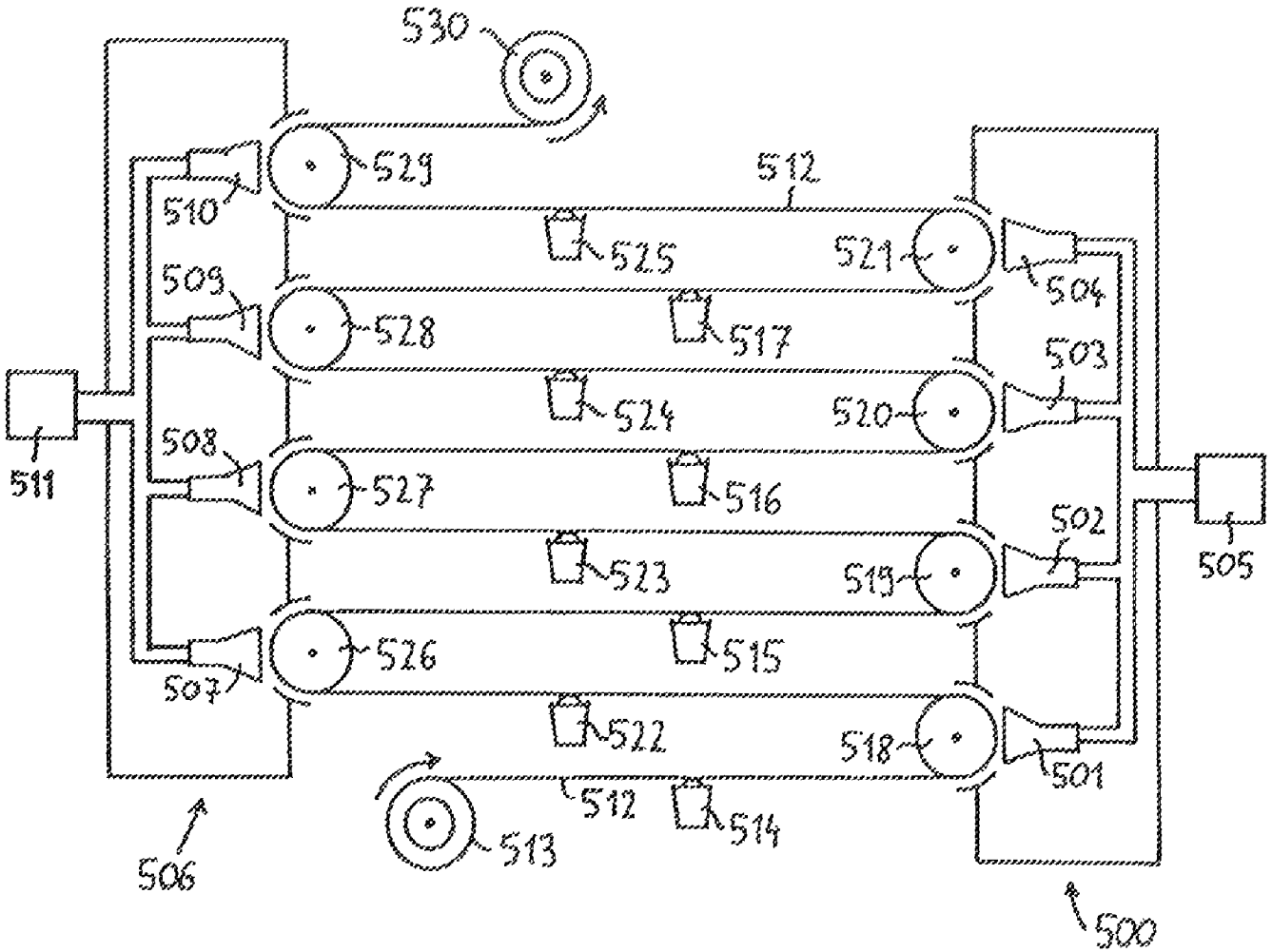
FIG. 5 shows a further embodiment of the invention in which a web is printed in four colours on both sides.

FIG. 5 shows an embodiment of the invention in which a web is printed on both sides in four-colour print. The printing press includes a first irradiation unit 500 with four electron beam generators 501 to 504 which are connected to a first vacuum system with a first pump system 505. The printing press also includes a second irradiation unit 506 with four electron beam generators 507 to 510 which are connected to a second vacuum system with a second pump system 511. A web 512 is led from a feeder roller 513 alternately through the first irradiation unit 500 and the second irradiation unit 506. The printing units 514 to 517 apply four different ink coatings to the underside of the web 512. Each time a new ink coating is applied, the web 512 is led through the first irradiation unit 500 via one of the deflection rollers 518 to 521 where the ink coatings are cured by the electron beam generators 501 to 504. Accordingly, the ink application units 522 to 525 apply four different coatings of ink to the upper side of the web 512. Each time a new ink coating is applied, the web 512 is led through the second irradiation unit 506 via one of the deflection rollers 526 to 529 where the ink coatings are cured by the electron beam generators 507 to 510. Having been printed four colours on both sides, the web is then fed to a take-up roller 530.

Figure 6:
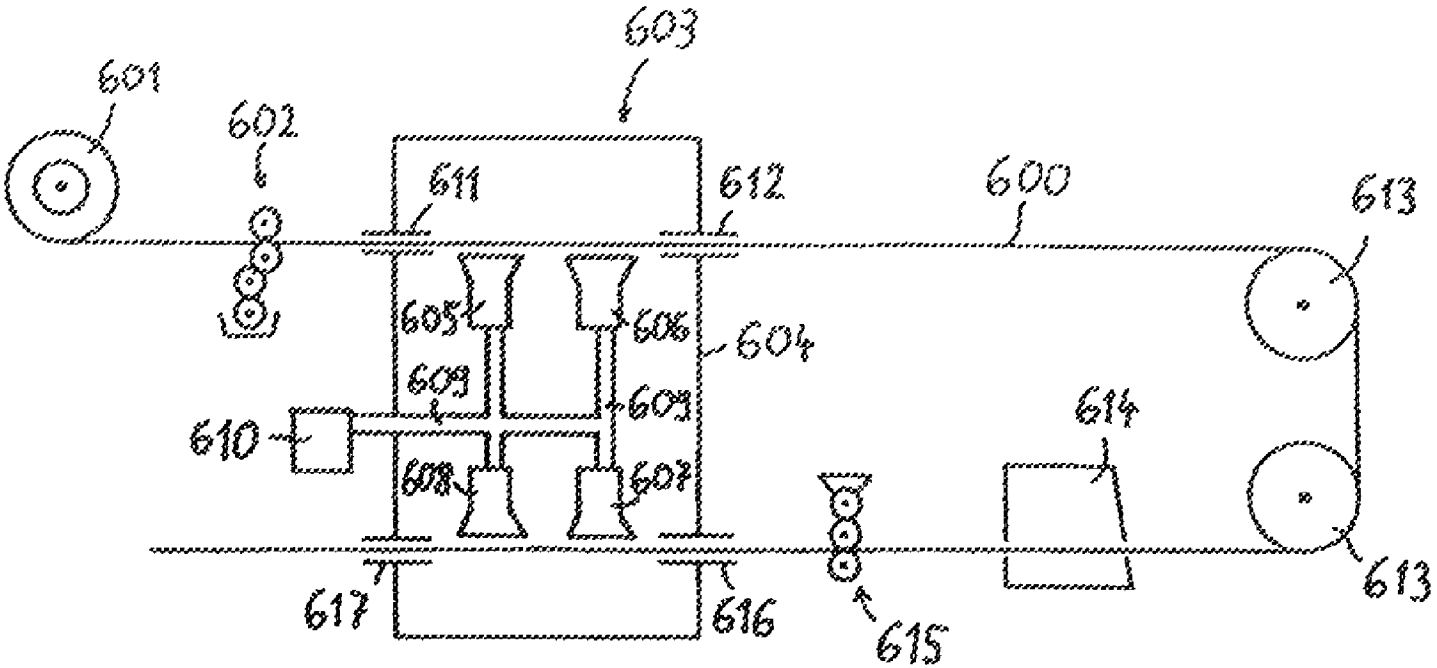
FIG. 6 shows a further embodiment in which the web is led through the irradiation unit with the aid of inlet and outlet slots.

Instead of deflection rollers, the web can also be conveyed through the screen of the irradiation unit via inlet and outlet gaps. In the embodiment shown in FIG. 6, a web 600 is fed to a printing unit 602 from a feeder roller 601 where a coating of ink is applied to the web 600.

For electron beam curing of the applied coatings a spatially delineated irradiation unit 603 is provided. This is surrounded by the screen 604. The irradiation unit 603 has four electron beam generators 605 to 608 which are connected to a vacuum pump 610 via the tubes 609.

The printed web passes through an inlet slot 611 into the irradiation unit 603 where it is beamed successively by two electron beam generators 605 and 606.

In the field of electron beam curing, the dose output of an irradiator states the irradiated dose per time unit. In the embodiment shown in FIG. 6, the radiation dose available for curing of the ink coating is composed of the contributions of the two electron beam generators 605 and 606. This allows a substantial increase in the radiation dose. This makes it possible to reliably cure even comparatively slow-reacting coatings. In addition to this, a sufficient radiation dose for curing the applied coatings can be provided even in the case of higher web speeds.

The web 600 leaves the irradiation unit 603 via an outlet slot 612 and passes via deflection rollers 613 to a punch-out unit 614. After the punch-out process, the web 600 is led to a varnish application unit 615 which applies a coating of varnish to the web 600. To cure the coating of varnish, the web 600 is led through an inlet slot 616 into the irradiation unit 603 where it is beamed successively by the two electron beam generators 607 and 608 whereby the total irradiation dose consists of the contributions from the two electron beam generators 607 and 608. Then the web 600 is led out of the irradiation unit 603 through the outlet slot 617 on the opposite side. As illustrated in the example of the punch-out unit 614, the web can pass through other processing stations after leaving the irradiation unit and before passing through the next application unit.

Figure 7:
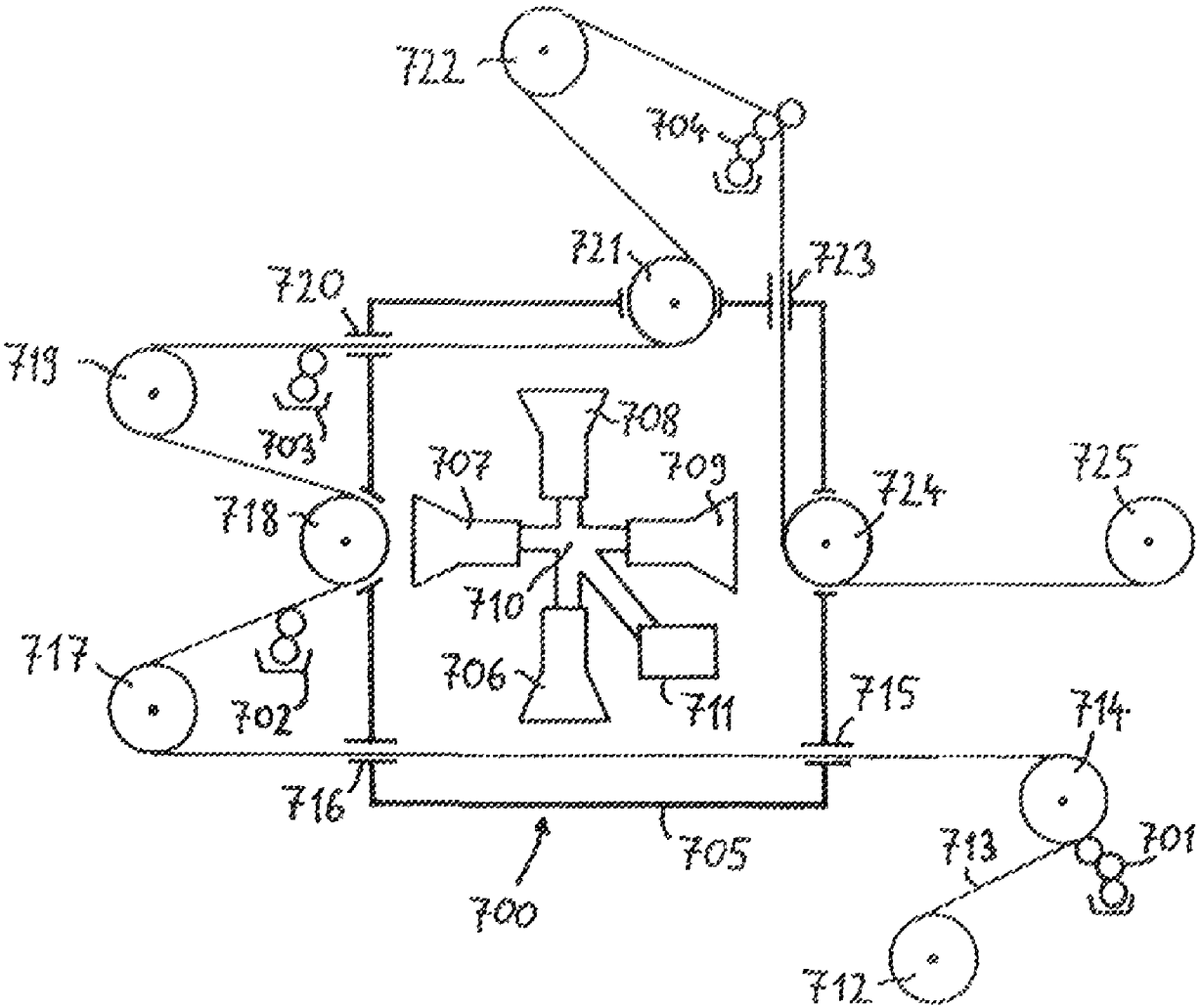
FIG. 7 shows an embodiment of a central dryer for electron beam curing with a compact irradiation unit.

FIG. 7 shows a further embodiment of the invention. Four application units 701, 702, 703 and 704 are arranged around a compact irradiation unit 700. The irradiation unit 700 is executed as a spatially delineated, separate module and surrounded by a screen 705. The irradiation unit 700 includes four electron beam generators 706, 707, 708 and 709. To generate the required operating vacuum, the four electron beam generators 706-709 are connected to a joint vacuum system 710 which is linked to a vacuum pump 711.

A web 713 is led from a feeder roller 712 to the first application unit 701 where a first coating is applied. The web 713 passes via a deflection roller 714 and an inlet slot 715 into the irradiation unit 700 where it is beamed by the first electron beam generator 706 and is then led to the second application unit 702 via an outlet slot 716 and a deflection roller 717. After the second coating is applied, the web 713 is passed via a deflection roller 718 through the irradiation unit 700 in order to cure the second coating by means of the second electron beam generator 707. Via the deflection roller 719 the web 713 passes to the third application unit 703 which applies a third coating and from there via an inlet slot 720 to the third electron beam generator 708 which cures the third coating.

The web 713 is led out of the irradiation unit 700 via a deflection roller 721 and passes via a further deflection roller 722 to the fourth application unit 704 which applies a further coating to the web 713. The coated web is then led via an inlet slot 723 back through the irradiation unit 700 where the newly applied coating is cured by the fourth electron beam generator 709. The web 713 is led out of the irradiation unit 700 via a deflection roller 724 and then on to the take-up roller 725.

The following features, alone or in any combination, can also represent advantageous embodiments of the described and/or claimed central dryer for electron beam curing:

According to an advantageous embodiment, the first electron beam generator is designed to cure a section of the first coating near the surface and the second electron beam generator to cure the first coating throughout. In this way a hard, matt, scratch-free surface can be generated without using matting agents.

According to an advantageous embodiment, the central dryer for electron beam curing includes a third application unit to apply a third coating to the web as well as a third electron beam generator arranged within the irradiation unit, whereby the web guiding system is designed in such a way as to feed the web successively into the first application unit, the first electron beam generator, the second application unit, the second electron beam generator, the third application unit, the third electron beam generator.

According to an advantageous embodiment, the third electron beam generator is designed for the electron beam curing of one or several previously applied coatings.

According to a further preferred embodiment, the application units are arranged on at least two levels above each other. This allows a space-saving arrangement of the application units. Compared with the familiar stand construction, in this embodiment the height of the hall or of the room in which the central dryer for electron beam curing is set up can be used to full advantage.

According to an advantageous embodiment, every application unit is allocated at least one electron beam generator arranged at approximately the corresponding height in the irradiation unit. In this way, the distances between an application unit and a corresponding electron beam generator can be kept to a minimum. Preferably, a number of electron beam generators are arranged over each other in the irradiation unit.

According to an advantageous embodiment, each electron beam generator has at least one electron exit window. An electron exit window should be sufficiently permeable to accelerated electrons. On the other hand, an electron exit window should be stable enough to stand the pressure difference between the ambient pressure and the vacuum.

According to a preferred embodiment, the central dryer for electron beam curing has at least one control unit for control of the dose output of the electron beam generators arranged in the irradiation unit, whereby the dose output of the electron beam generators can be controlled individually. This means that the dose output of an electron beam generator can be adapted to meet the requirements of the respective coatings.

According to an advantageous embodiment, the central dryer for electron beam curing includes a high-voltage generator to generate the acceleration voltage for the electron beam generators arranged in the irradiation unit. The high-voltage generator is a relatively expensive component. As only one high-voltage generator is required to supply the electron beam generators arranged in the irradiation unit, the overall costs are kept low.

According to an advantageous embodiment, the web consists of a series of plates or sheets or beakers led successively through the central dryer for electron beam curing. The web must not necessarily be a continuous stead. Instead, the guide system can be designed in such a way as to lead individual plates, sheets or beakers through the central dryer for electron beam curing in order to apply different coatings successively to the plates, sheets or beakers.

According to an advantageous embodiment, the web guiding system includes a roller system to guide the web.

According to an advantageous embodiment, the central dryer for electron beam curing has one or more of the following features:

- a feeder roller for the web, whereby the web is fed from the feeder roller to the first application unit;
- a take-up roller for the web, whereby the web is fed to the take-up roller after passing through the irradiation unit;
- at least one inlet roller, whereby the web is fed into the irradiation unit by means of an inlet roller arranged on the web inlet side;
- at least one outlet roller, whereby the web is led out of the irradiation unit by means of an outlet roller arranged on the web outlet side;
- at least one deflection roller, whereby the web is passed through the irradiation unit by means of the deflection roller;
- at least one inlet slot, whereby the web is fed into the irradiation unit by means of an inlet slot arranged on the web inlet side;
- at least one outlet slot, whereby the web is led out of the irradiation unit by means of an outlet slot arranged on the web outlet side.

The following features, alone or in any combination, can also represent advantageous embodiments of the described and/or claimed printing press:

According to an advantageous embodiment, the printing press is a printing press for at least one of the following printing processes: flexographic, intaglio, screen, offset printing. Ink systems for electron beam curing provide hard, chemicals and abrasion-resistant, high-gloss ink films. If a newly applied ink coating is fixed using electron beam curing before the application of further coats, this prevents the smearing or running of the inks from the various application units. A high-quality print is received regardless of the consistency of the ink.

According to a preferred embodiment, the printing press is designed for one-sided printing of the web. According to an alternative embodiment, the printing press is designed for double-sided printing of the web.

According to an advantageous embodiment, the printing press includes two printing units arranged around the irradiation unit to realise a two-colour print.

According to an advantageous embodiment, the printing press includes a lining unit as well as at least one printing unit which are arranged around the irradiation unit. A printing press in this embodiment can be used, for example, to print a continuous strip of paper or cardboard and then line it with a plastic foil.

According to an advantageous embodiment, the printing press is designed for use in printing labels or packaging or for finishing furniture foils.

The invention claimed is:

1. Central dryer for electron beam curing with a first application unit to apply a first coating to a web;

an irradiation unit in which a first electron beam generator and a second electron beam generator are arranged for irradiation of the web, the irradiation unit having a screen for the electron beam generators, the screen screening against high-energy radiation generated in the irradiation unit, whereby the electron beam generators arranged in the irradiation unit have connections for at least one pump system to generate an operating vacuum; and a web guiding system arranged to (a) feed the web through the screen into the irradiation unit for irradiation after passing through the first application unit, thereafter (b) feed the web through the screen out of the irradiation unit, thereafter (c) feed the web to a second application unit for application of a second coating to the web, thereafter (d) feed the web through the screen back into the irradiation unit for additional irradiation, thereafter (e) feed the web through the screen back out of the irradiation unit.

2. Central dryer for electron beam curing according to claim 1, characterised in that the web guiding system is designed to feed the web into the irradiation unit after passing through the first application unit where the web is irradiated by the first electron beam generator and by the second electron beam generator and then led back out of the irradiation unit.

3. Central dryer for electron beam curing according to claim 1, characterised in that the first electron beam generator and the second electron beam generator are designed for electron beam curing of the first coating.

4. Central dryer for electron beam curing according to claim 1, characterised in that the first electron beam generator is designed for the electron beam curing of the first coating and the second electron beam generator is designed for the electron beam curing of one or more previously applied coatings.

5. Central dryer for electron beam curing according to claim 1, characterised in that the web guiding system is designed to feed the web to the irradiation unit after passing through the first application unit where the web is beamed by the first electron beam generator and then led out of the irradiation unit and fed into the second application unit and the web, after passing through the second application unit is fed into the irradiation unit where it is beamed by the second electron beam generator and then led out of the irradiation unit.

6. Central dryer for electron beam curing according to claim 1, characterised by at least three application units outside the irradiation unit and at least three electron beam generators arranged inside the irradiation unit, whereby each application unit is assigned at least one electron beam generator and the web guiding system is designed to feed the web after passing through an application unit to the irradiation unit where the web is beamed by the at least one assigned electron beam generator and then led back out of the irradiation unit.

7. Central dryer for electron beam curing according to claim 1, characterised in that an electron beam generator assigned to an application unit is designed to cure at least one coating applied by at least one previously passed application unit.

8. Central dryer for electron beam curing according to claim 1, characterised by one or more of the following features:

- each of the electron beam generators arranged inside the irradiation unit extends over the whole width of the web;
- the irradiation is executed as a self-contained, separate module;
- the irradiation unit is arranged in a spatially delineated area of the central dryer for electron beam curing;
- the application units are arranged in a first spatially delineated area of the central dryer for electron beam curing and the irradiation unit is arranged in a second spatially delineated area of the central dryer for electron beam curing;
- the first application unit is arranged adjacent the irradiation unit;
- the irradiation unit is arranged centrally with respect to the application units;
- the web passes into and out of the irradiation unit at least three times.

9. Central dryer for electron beam curing according to claim 1, characterised in that at least one of said application units includes at least one of the following: a laminating unit, a lining unit, an adhesive application unit, an ink application unit, a varnish application unit, a powder application unit, a coating unit, an extruder, an extruder with moulding tool.

10. Central dryer for electron beam curing according to claim 1, characterised in that at least one of said coatings includes one or more of the following: an ink coating, a varnish coating, an adhesive coating, a lining foil with adhesive, a laminating coating, a plastic coating, a siliconisation, a finishing coating.

11. Central dryer for electron beam curing according to claim 1, characterised in that one or more of the application units are printing units for at least one of the following printing processes: flexographic, intaglio, screen, offset printing.

12. Central dryer for electron beam curing according to claim 1, characterised in that between one of the application units and one electron beam generator assigned to the application unit one or more of the following are arranged: a web dryer, a convection dryer, a solvent dryer, an excimer dryer, a UV dryer, an IR dryer, a heat treatment unit.

13. Central dryer for electron beam curing according to claim 1, characterised in that the electron beam generators arranged inside the irradiation unit are connected to a joint vacuum system for all electron beam generators.

14. Central dryer for electron beam curing according to claim 13, characterised in that the joint vacuum system has a pump system for the generation of the operating vacuum.

15. Printing press which comprises at least one central dryer for electron beam curing according to claim 1.

16. Method for application of at least two coatings on a web, the method utilizing an irradiation unit in which a first electron beam generator and a second electron beam generator are arranged for irradiation of the web, the irradiation unit having a screen for the electron beam generators, the screen screening against high-energy radiation generated in the irradiation unit, the method comprising the following steps:

- applying a first coating to the web;
- thereafter feeding the web through the screen into the irradiation unit and irradiating the web with electrons by the first electron beam generator;
- thereafter leading the web through the screen out of the irradiation unit;
- thereafter applying outside the irradiation unit a second coating to the web;
- thereafter feeding the web through the screen back into the irradiation unit and irradiating the web with electrons by the second electron beam generator; and
- thereafter leading the web through the screen back out of the irradiation unit.

17. The central dryer of claim 1, wherein the web passes into and out of the irradiation unit at least three times.

18. The central dryer of claim 1, wherein the web passes into and out of the irradiation unit at least four times.

19. The central dryer of claim 5, wherein the web guiding system is further designed to feed the web into a third application unit and the web, after passing through the third application unit, is fed into the irradiation unit where it is beamed by a third electron beam generator and then led out of the irradiation unit.

20. The method of claim 16, further comprising the steps of feeding the web through the screen into the irradiation unit a third time and thereafter leading the web through the screen back out of the irradiation unit a third time.

21. The method of claim 16, further comprising the steps of applying outside the irradiation unit a third coating to the web; thereafter feeding the web through the screen into the irradiation unit a third time and irradiating the web with electrons and thereafter leading the web through the screen back out of the irradiation unit a third time.

22. The method of claim 21, further comprising the steps of applying outside the irradiation unit a fourth coating to the web; thereafter feeding the web through the screen into the irradiation unit a fourth time and irradiating the web with electrons and thereafter leading the web through the screen back out of the irradiation unit a fourth time.

23. The method of claim 16, further comprising the step of irradiating the first coating with electrons from the second electron beam generator.

24. The method of claim 21, wherein the first coating is irradiated by at least the first electron beam generator, the second coating is irradiated by at least the second electron beam generator, and the third coating is irradiated by at least a third electron beam generator located within the irradiation unit.

25. The method of claim 16, characterized by one or more of the following features:

(a) each of the electron beam generators arranged inside the irradiation unit extends over the whole width of the web;

(b) the irradiation is executed as a self-contained, separate module; and (c) the web passes into and out of the irradiation unit at least three times.

26. The method of claim 16, wherein at least one of the coatings is applied by an application unit selected from the group consisting of a laminating unit, a lining unit, an adhesive application unit, an ink application unit, a varnish application unit, a powder application unit, a coating unit, an extruder, an extruder with moulding tool.

27. The method of claim 16, wherein at least one of the coatings is selected from the group consisting of an ink coating, a varnish coating, an adhesive coating, a lining foil with adhesive, a laminating coating, a plastic coating, a siliconisation, a finishing coating.

* * * * *